United States Patent [19]

Holden et al.

[11] Patent Number: 4,583,774

[45] Date of Patent: Apr. 22, 1986

[54] BATTERY DOOR LATCHING MECHANISM

[75] Inventors: Irving H. Holden, Boca Raton; Robert D. Lloyd, Sunrise; Charles W. Mooney, Lake Worth; Robert E. Phipps, Pompano Beach, all of Fla.

[73] Assignee: Motorola, Inc., Schaumburg, Ill.

[21] Appl. No.: 647,097

[22] Filed: Sep. 4, 1984

[51] Int. Cl.[4] ..... E05C 19/06

[52] U.S. Cl. ..... 292/19; 220/306

[58] Field of Search ..... 292/19, 70, 76, DIG. 38; 220/306, 315

[56] References Cited

U.S. PATENT DOCUMENTS

| | | | |
|---|---|---|---|
| 2,000,466 | 5/1935 | Howard . | |
| 2,708,779 | 5/1955 | Tiger | 292/76 X |
| 3,075,165 | 1/1963 | Donlevy . | |
| 3,315,999 | 4/1967 | Hahn et al. | 292/76 |
| 3,466,075 | 9/1969 | Fernandez et al. | 292/19 |
| 3,744,828 | 7/1973 | Goldberg . | |
| 3,994,416 | 11/1976 | Mulligan . | |
| 4,303,176 | 12/1981 | Swartzbaugh . | |

FOREIGN PATENT DOCUMENTS

| | | | |
|---|---|---|---|
| 695466 | 8/1940 | Fed. Rep. of Germany | 292/70 |

*Primary Examiner*—Richard E. Moore

*Attorney, Agent, or Firm*—Mark P. Kahler; Joseph T. Downey; Edward M. Roney

[57] ABSTRACT

A battery door latching mechanism comprising two cantilevered posts incorporated in the base housing of a radio receiving device that interface with a headed rib on the base of a battery door. A recessed area in the battery housing surrounds the two cantilevered members, and prevents them from becoming overstressed due to deflection during shock, yet allowing them to deflect enough for attachment of the battery door to the housing.

2 Claims, 4 Drawing Figures

BATTERY DOOR LATCHING MECHANISM

BACKGROUND OF THE INVENTION

1. Field of the Invention

The present invention relates to latching mechanisms and more particularly to a battery door latching mechanism for a low profile radio receiver device.

2. Description of the Prior Art

In the past, various battery door closing techniques have been used for radio receiver devices. One such device uses a single cantilevered bumped tongue in which the latching mechanism occurs above the battery's top surface thereby adding to the overall package thickness. The tongue must be significantly thick enough to provide sufficient locking strength, as opposed to an anti-dust intrusion ledge which does not require strength.

In another device a dual cantilevered bumped tongue is used in which the latch mechanism occurs on the sides of the battery, adjacent to the radio receiving device top surface. This design, however prevents the placement of activation switches which are used for testing and are triggered by special battery doors in the area around the battery.

In still in another device a throw-latch on the battery door is utilized wherein the latching mechanism occurs above the battery top surface which again increases the overall thickness of the radio receiver device much like the single cantilevered bumped tongue device.

Similar to the previously mentioned mechanism, the throw-latch may be designed on the main housing of the radio receiving device instead of the battery door wherein the throw-latch is mounted on the bottom of the main housing and is thrown out into the battery door to lock it into position. However, with this latching design, the throw-length required to retract and engage the latch results in a greater thickness requirement for the radio receiver housing.

In still another device, internally bumped assembly tracks are used in which latching bumps are located on assembly tracks of the main housing that mate with recesses in the ribs on the battery door that slide in these tracks. Generally, this system is used on a top loaded housing, where the battery door slides on the side of the housing and interacts with only the main housing. The use of this mechanism cannot be contemplated for use with back loaded housings because the battery door would have to interact with both the main housing and the back cover.

SUMMARY OF THE INVENTION

Accordingly, one object of this invention is to provide a novel battery door latching mechanism which enables the lowest profile thickness possible for the radio receiver housing.

It is another object of the present invention to provide a battery door latching mechanism which does not interfere with activation switches that are triggered by the battery door when it is put in place.

It is still another object of the present invention to provide a battery door latching mechanism which includes a means for preventing the overstressing of the components of the battery door latching mechanism.

The above and other objects and advantages of the present invention are provided by a battery door latch mechanism which includes in the preferred embodiment two cantilevered posts incorporated in the base housing that interface with a headed rib at the base of the battery door. A recessed area in the battery housing surrounds the posts, preventing them from becoming overstressed due to deflection during shock, yet allowing them to deflect enough for attachment of the battery door to the housing.

BRIEF DESCRIPTION OF THE DRAWINGS

A more complete appreciation of the invention and many of the attendant advantages thereof will be readily attained as the same becomes better understood by reference to the following detailed description when considered in connection with the accompanying drawings, wherein.

DESCRIPTION OF THE PREFERRED EMBODIMENTS

Figure 1:
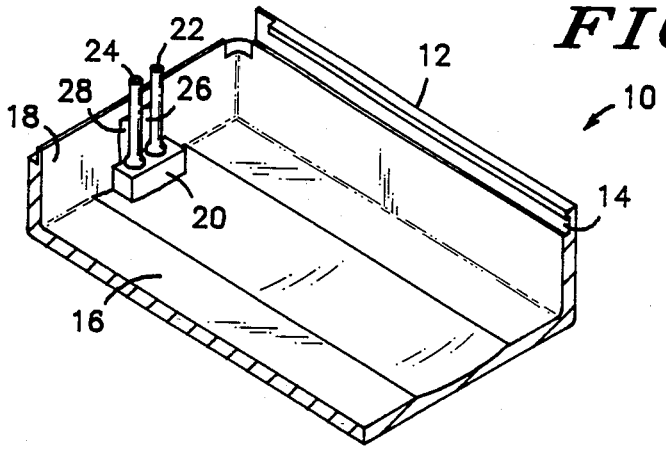
FIG. 1 is a partial top perspective view of a radio receiver housing with a portion of the present invention molded therein.

Referring now to the drawings, wherein like reference numerals designate identical and corresponding parts throughout the several views, and more particularly to FIG. 1 thereof, a radio receiver device housing 10 is illustrated. The receiver housing 10 includes the sidewall 12 which has the recessed groove 14 therein for slidably receiving a flanged portion of a battery door cover which will be explained in greater detail hereinafter. The receiver housing 10 further includes the front wall 16 and the bottom wall 18. The sidewall 12, the front wall 16 and the bottom wall 18 partially define a battery housing receiving area for the radio receiver device 10. Molded into the front wall 16 and the botton wall 18 is a base 20 which carries the two cantilevered posts 22 and 24. The posts 22 and 24 are stiffened for stability by the respective rib portions 26 and 28 which are connected to the bottom wall 18. In the preferred embodiment housing 10 as well as base 20, the cantilevered posts 22 and 24 and the securing ribs 26 and 28 are molded features of the housing 10. The base 20 is also used to support a printed circuit board (not shown). It should be further understood that the actual battery housing is not shown installed in FIG. 1.

Figure 2:
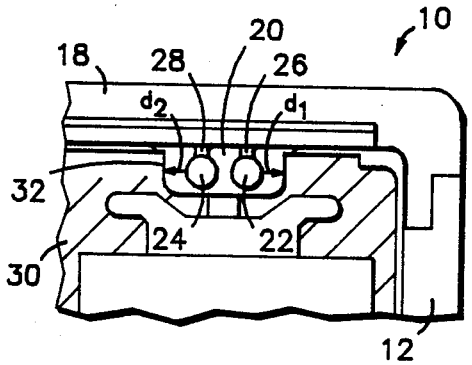
FIG. 2 is a partial top view of the radio receiver housing with a portion of the battery door latching mechanism of the present invention molded therein and depiction of the battery housing's recess that limits deflection of the cantilevered posts.

Referring now to FIG. 2, a partial top view of FIG. 1 with a battery housing 30 installed therein is illustrated. The battery housing 30 includes a recessed area 32 which limits the deflection of the two cantilevered posts 22 and 24 and thus protects the two cantilevered posts 22 and 24 from being overstressed due to over deflection caused by shock. Thus, the cantilevered post 22 would be allowed to deflect the distance d1 and the cantilevered post 24 would be allow to deflect the distance d2. The distances d1 and d2 are sufficient to allow enough deflection of the post to allow for entry of the headed rib of the battery door which will explained in more detail when referring to FIG. 3.

Figure 3:
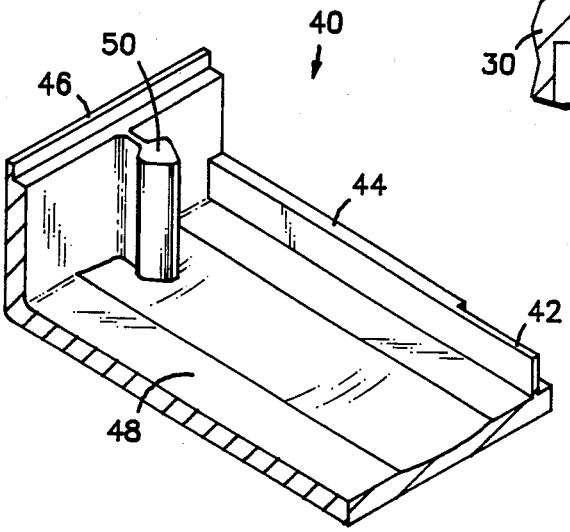
FIG. 3 is a partial top perspective view of a battery door of a radio receiver device with a portion of the battery door latching mechanism of the present invention molded therein.
Figure 4:
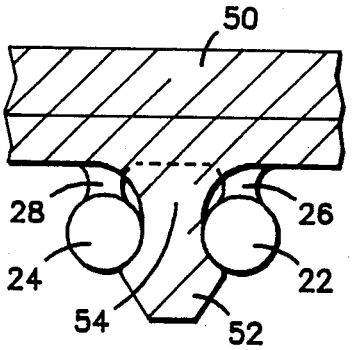
FIG. 4 is a partial cross-sectional view of the battery door latching mechanism of the present invention shown in the latched position.

Referring now to FIG. 3, a partial top perspective view of the battery door 40 is illustrated. The battery door 40 includes the side wall 42 having a flanged portion 44 and similar side wall and flanged portion on its opposite side (not shown) which is received by the recessed groove 14 of the side wall 12 of the radio receiver housing 10 as illustrated in FIG. 1. The battery door further includes the bottom wall portion 46 and the back wall portion 48. The bottom wall portion 46 and back wall 48 include an integral molded headed rib 50 on the inner surface thereof, which is designed for being received between the two cantilevered posts 22 and 24 as illustrated in FIG. 4. As can be seen, the headed rib 50 includes a tapered end portion 52 which allows the rib 50 to gradually deflect the post 22 and 24 to the sides. Then the portion 54 behind the tapered end portion 52 and defined by the steeper conforming radii nests the post in place and provides for a retaining force to hold the battery door 40 in place.

Obviously, numerous (additional) modifications and variations of the present invention are possible in light of the above teachings. It is therefore to be understood that within the scope of the appended claims, the invention may be practiced otherwise than specifically described herein.

What is claimed as new and desired to be secured by Letters Patent of the United States is:

1. A door latch assembly comprising:

a housing for containing electrical apparatus therein, said housing including a compartment having a side wall;

a door capable of slidably engaging said housing so as to cover said compartment, said door including a back wall and a bottom wall oriented in an L-shaped configuration;

a pair of spaced flexible members, connected to said housing and extending substantially parallel to each other and to said side wall;

an engaging member including a rib having opposed ends, said rib being attached to said bottom wall along the lengthwise dimension of said rib, said rib including a head extending between the ends of said rib and situated facing away from said bottom wall, said head including a tapered portion along the lengthwise dimension of said head, said tapered portion facing away from said bottom wall in a direction perpendicular to said flexible members when said engaging member is urged between said flexible members during closure of said door.

2. A door latch assembly, according to claim 1, further comprising:

limiting means, operably coupled to said housing, for limiting the deflection of said spaced members away from each other.

* * * * *